US011106172B2

(12) United States Patent
Luke

(10) Patent No.: US 11,106,172 B2
(45) Date of Patent: Aug. 31, 2021

(54) ROLLER AND COUPLER TRANSITIONS

(71) Applicant: HEWLETT-PACKARD DEVELOPMENT COMPANY, L.P., Spring, TX (US)

(72) Inventor: Jeff Luke, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/966,677

(22) PCT Filed: May 18, 2018

(86) PCT No.: PCT/US2018/033476
§ 371 (c)(1),
(2) Date: Jul. 31, 2020

(87) PCT Pub. No.: WO2019/221753
PCT Pub. Date: Nov. 21, 2019

(65) Prior Publication Data

US 2021/0034006 A1 Feb. 4, 2021

(51) Int. Cl.

| | |
|---|---|
| ***G03G 15/00*** | (2006.01) |
| ***G03G 21/16*** | (2006.01) |
| ***G03G 15/08*** | (2006.01) |

(52) U.S. Cl.
CPC ..... *G03G 15/757* (2013.01); *G03G 15/0808* (2013.01); *G03G 21/1647* (2013.01); *G03G 2221/1654* (2013.01); *G03G 2221/1657* (2013.01)

(58) Field of Classification Search
CPC ..... G03G 15/757; G03G 15/0808; G03G 21/1647; G03G 21/186; G03G 2221/1654; G03G 2221/1657
See application file for complete search history.

(56) References Cited

U.S. PATENT DOCUMENTS

| | | | |
|---|---|---|---|
| 5,374,982 | A | 12/1994 | Boockkholdt |
| 7,130,562 | B2 | 10/2006 | Foster et al. |
| 7,899,364 | B2 | 3/2011 | Chadani et al. |
| 8,086,135 | B2 | 12/2011 | Koyama et al. |
| 8,874,004 | B2 | 10/2014 | Takasaka et al. |
| 9,213,303 | B2 | 12/2015 | Maul |
| 9,778,613 | B2 | 10/2017 | Komatsu et al. |
| 9,836,015 | B2 | 12/2017 | Morioka et al. |

(Continued)

FOREIGN PATENT DOCUMENTS

| | | | |
|---|---|---|---|
| EP | 1864821 | A1 | 12/2007 |
| JP | 4958942 | B2 | 6/2012 |

*Primary Examiner* — Sophia S Chen
(74) *Attorney, Agent, or Firm* — Staas & Halsey, LLP

(57) ABSTRACT

Examples described herein relate to a system for a print cartridge. For instance, the system may include a coupling member to connect to a printing device, a roller mechanism coupled to the coupling member, where a position of the coupling member relative to the roller mechanism remains the same as the coupling member and roller mechanism transition between a first position and a second position, and an urging member positioned away from the coupling member, where the urging member is to transition the roller mechanism from the second position to the first position.

11 Claims, 4 Drawing Sheets

(56) References Cited

U.S. PATENT DOCUMENTS

| | | | | |
|---|---|---|---|---|
| 9,841,729 | B2 | 12/2017 | Ueno et al. | |
| 9,857,765 | B2 | 1/2018 | Ueno et al. | |
| 9,869,960 | B2 | 1/2018 | Ueno et al. | |
| 2003/0228173 | A1 | 12/2003 | Nittani et al. | |
| 2006/0245784 | A1 | 11/2006 | Tsuzuki et al. | |
| 2017/0300007 | A1* | 10/2017 | Lin | G03G 15/757 |
| 2018/0004153 | A1 | 1/2018 | Shuhama et al. | |
| 2018/0113417 | A1 | 4/2018 | Rong et al. | |

* cited by examiner

ROLLER AND COUPLER TRANSITIONS

CROSS REFERENCE TO RELATED APPLICATIONS

This application is a U.S. National Stage Application which claims the benefit under 35 U.S.C. § 371 of International Patent Application No. PCT/US2018/033476 filed on May 18, 2018, the contents of which are incorporated herein by reference.

BACKGROUND

Imaging systems, such as printers, may allow text, images, and/or graphics, etc. to be printed onto print media (e.g., paper, plastic, etc.). Imaging systems generally include print cartridges to assist in the transfer of print substance to print media. The transfer of print substance to print media may produce text, images, and/or graphics, etc. on print media

DETAILED DESCRIPTION

A print cartridge may be included in a printing device to produce text, images, and/or graphics, etc. on print media. The print cartridge may include a coupling member, a roller mechanism, and an urging member. The roller mechanism may be connected to a container housing. The coupling member may be connected to a drive mechanism. The drive mechanism may connect the coupling member to the printing device. The print cartridge may assist the printing device in the production of text, images, and/or graphics on print media by assisting in the transfer of print substance to print media. However, if the print cartridge fails, a user may have difficulty determining why the print cartridge failed and/or repairing the print cartridge. In addition, the print cartridge may be expensive to produce.

Accordingly, this disclosure describes roller and coupler transitions that allow coupling members and roller mechanisms to connect to a printing device in a manner that reduces the cost of print cartridge production, make it easier for a user to determine why the print cartridge failed, and make is easier for a user to repair the print cartridge. For example, the print cartridge may include a coupling member coupled to a roller mechanism. The position of the coupling member relative to the roller mechanism may not change as the coupling member and roller mechanism move. In some examples, the urging member may be positioned away from the coupling member to transition the roller mechanism and the coupling member from a second position to a first position.

Figure 1:
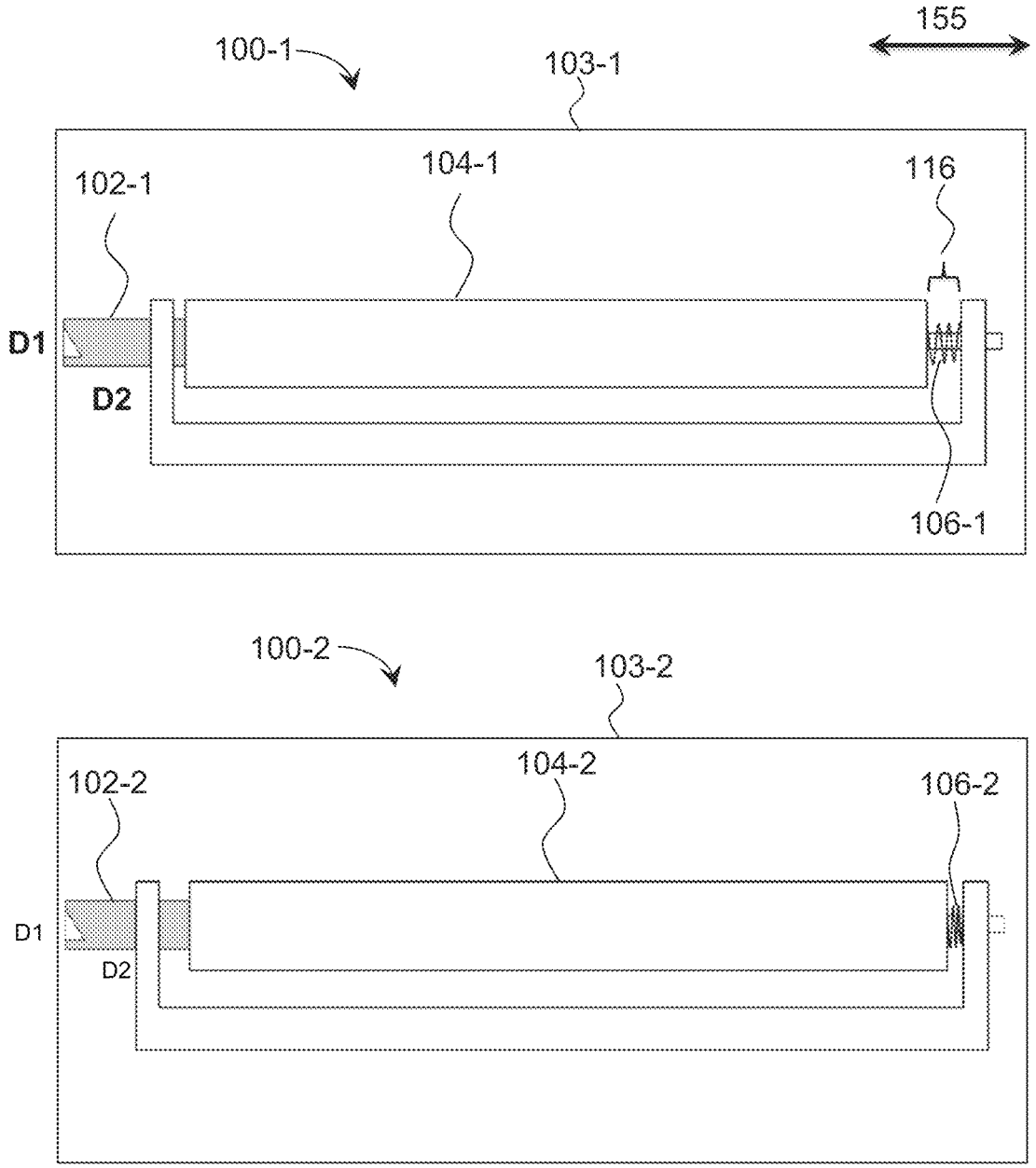
FIG. 1 illustrates example systems consistent with the disclosure.

FIG. 1 illustrates example systems 100-1 and 100-2 consistent with the disclosure. The systems 100-1 and 100-2 may be implemented in a variety of imaging systems, such as printers, copiers, etc., for example. System 100-1 of FIG. 1 illustrates an example system in a first position and system 100-2 of FIG. 1 illustrates an example system in a second position. In some examples, the systems 100-1 and 100-2 may include a coupling member 102-1 and 102-2. The coupling member 102-1 and 102-2 may be connected to a printing device 103-1 and 103-2. In some examples, the coupling member 102-1 and 102-2 may transition in a lateral direction while connected to the printing device 103-1 and 103-2. For example, the coupling member 102-1 and 102-2 may transition in a direction denoted by arrow 155 while connected to the printing device 103-1 and 103-2. In some examples, the coupling member 102-1 and 102-2 may move and/or transition relative to the printing device 103-1 and 103-2. For example, the coupling member 102-1 and 102-2 may move and/or transition as the printing device 103-1 and 103-2 remains in a static position. In some examples, the coupling member 102-1 and 102-2 connected to the printing device 103-1 and 103-2 may assist in the transfer of print substance to print media. It should be understood that when an element is referred to as being "connected to" or "coupled to" another element, it may be directly connected, or coupled with the other element or intervening elements may be present.

In some examples, the coupling member 102-1 and 102-2 connected to the printing device 103-1 and 103-2 may have a uniform diameter. For example, the diameter of the coupling member 102-1 and 102-2 may be the same throughout the coupling member 102-1 and 102-2. In some examples, the coupling member 102-1 and 102-2 may be hollow on the inside. That is, an opening hole may form in the center of the coupling member 102-1 and 102-2 to create a hollow center of the coupling member 102-1 and 102-2. However, this disclosure is not so limited. In some examples, the coupling member 102-1 and 102-2 may be a solid member that is not hollow on the inside. For example, the coupling member 102-1 and 102-2 may be a solid object with not gaps or space between it. In some examples, a hollow coupling member 102-1 and 102-2 may reduce the cost of producing the coupling member 102-1 and 102-2. In some examples, the coupling member 102-1 and 102-2 may transition with a roller mechanism 104-1 and 104-2.

That is, the coupling member 102-1 and 102-2 may be coupled to the roller mechanism 104-1 and 104-2. As used herein, "roper mechanism" refers to a device used to transfer print substance from a print substance supply to print media, either directly or indirectly. The systems 100-1 and 100-2 may utilize a variety of different roller mechanisms 104-1 and 104-2. For example, the roller mechanism 104-1 and 104-2 may be an organic photo conductor. In addition, the roller mechanism 104-1 and 104-2 may be a developer roller. The coupling member 102-1 and 102-2 may be rigidly connected to the roller mechanism 104-1 and 104-2. For example, the coupling member 102-1 and 102-2 and the roller mechanism 104-1 and 104-2 may be coupled in a manner that allows the coupling member 102-1 and 102-2 and the roller mechanism 104-1 and 104-2 to move and/or transition together. In some examples, the roller mechanism 104-1 and 104-2 and the coupling member 102-1 and 102-2 may transition together in a direction as denoted by arrow 155. That is, the roller mechanism 104-1 and 104-2 and the coupling member 102-1 and 102-2 may transition and/or move in a lateral direction.

In some examples, the position of the coupling member 102-1 and 102-2 relative to the roller mechanism 104-1 and 104-2 may remain the same as the coupling member 102-1 and 102-2 and the roller mechanism 104-1 and 104-2 transition between a first position 100-1 and a second position 100-2. For example, the coupling member 102-1 and 102-2 may move the same distance 116 as the roller mechanism 104-1 and 104-2 when the coupling member 102-1 and 102-2 and the roller mechanism 104-1 and 104-2 transition between positions together. That is, the positioning of the roller mechanism 104-1 and 104-2 relative to the coupling member 102-1 and 102-2 is constant and does not change.

In some examples, the coupling member 102-1 and 102-2 may have a first diameter D1 and a second diameter D2.

In an example, the first diameter D1 of the coupling member 102-1 and 102-2 may be less than the second diameter D2 of the coupling member 102-1 and 102-2. The first diameter D1 of the coupling member 102-1 and 102-2 is located at distal ends of the coupling member 102-1 and 102-2 and the second diameter D2 of the coupling member 102-1 and 102-2 is located in a middle of the coupling member 102-1 and 102-2.

In another example, a diameter D1 and D2 throughout the coupling member 102-1 and 102-2 is unchanged.

In some examples, the systems 100-1 and 100-2 may include an urging member 106-1 and 106-2 to transition the roller mechanism 104-1 and 104-2. In some examples, the urging member 106-1 and 106-2 may be connected to the roper mechanism 104-1 and 104-2. However, this disclosure is not so limited. For example, the urging member 106-1 and 106-2 may contact the roller mechanism 104-1 and 104-2. In some examples, the urging member 106-2 may exert force to transition the roller mechanism 104-2, while in contact with the roller mechanism 104-2. In some example, the urging member 106-1 and 106-2 may not be in contact with the roller mechanism 104-1 and 104-2. For example, the urging member 106-2 may exert force on the roller mechanism 104-2 with an object between the urging member 106-2 and the roller mechanism 104-2. That is, the urging member 106-2 may not be in direct contact with the roller mechanism 104-2 as the force is exerted from the urging member 106-2 to the roller mechanism 104-2. As used herein, "urging member" refers to a device used to exert a force on the roller mechanism, either through direct or indirect contact, and cause the roller mechanism to transition and/or move due to the force excreted by the device.

In some example, the urging member 106-2 may transition the roller mechanism 104-2 and the coupling member 102-2 from a second position 100-2 to a first position 100-1. As used herein, "second position" refers to a position in which the roller mechanism is compressing the urging member and/or the roller mechanism is pushed towards the urging member. System 100-2 of FIG. 1 illustrates a roller mechanism 104-2 in a second position. For example, the roller mechanism 104-2 may be exerting force on the urging member 106-2 when in a second position 100-2. The force exerted by the roller mechanism 104-2 on the urging member 106-2 may compress the urging member 106-2. As used herein, "first position" refers to a position in which the roller mechanism is pushed away from the urging member. System 100-1 of FIG. 1 illustrates a roller mechanism 104-1 in a first position. For example, the roller mechanism 104-1 may be positioned away from the urging member 106-1 so that the roller mechanism 104-1 does not exert force on the urging member 106-1 when in a first position 100-1. That is, the roller mechanism 104-1 does not compress the urging member 106-1 when in a first position.

In some examples, an urging member 106-1 and 106-2 may be a spring. However, this disclosure is not so limited. That is, an urging member may be a device that is capable of exerting a force and cause the roller mechanism to transition from the second position 100-2 to the first position 100-1. For example, an urging member 106-1 and 106-2 may be a wedge mechanism, elastomer, etc. that can apply force and/or push the roller mechanism 104-2 from a second position 100-2 to a first position 100-1 either directly or indirectly.

In some examples, as the urging member 106-2 exerts a force on the roller mechanism 104-2, the coupling member 102-2 may experience the same force and transition with the roller mechanism 104-2. That is, the urging member may cause both the roller mechanism 104-2 and the coupling member 102-2 to transition and/or move in the same direction. In some examples, the urging member 106-1 and 106-2 may cause the coupling member 102-1 and 102-2 to connect with the printing device 103-1 and 103-2 as the force is exerted on the roller mechanism 104-2 and the coupling member 102-2.

Figure 2:
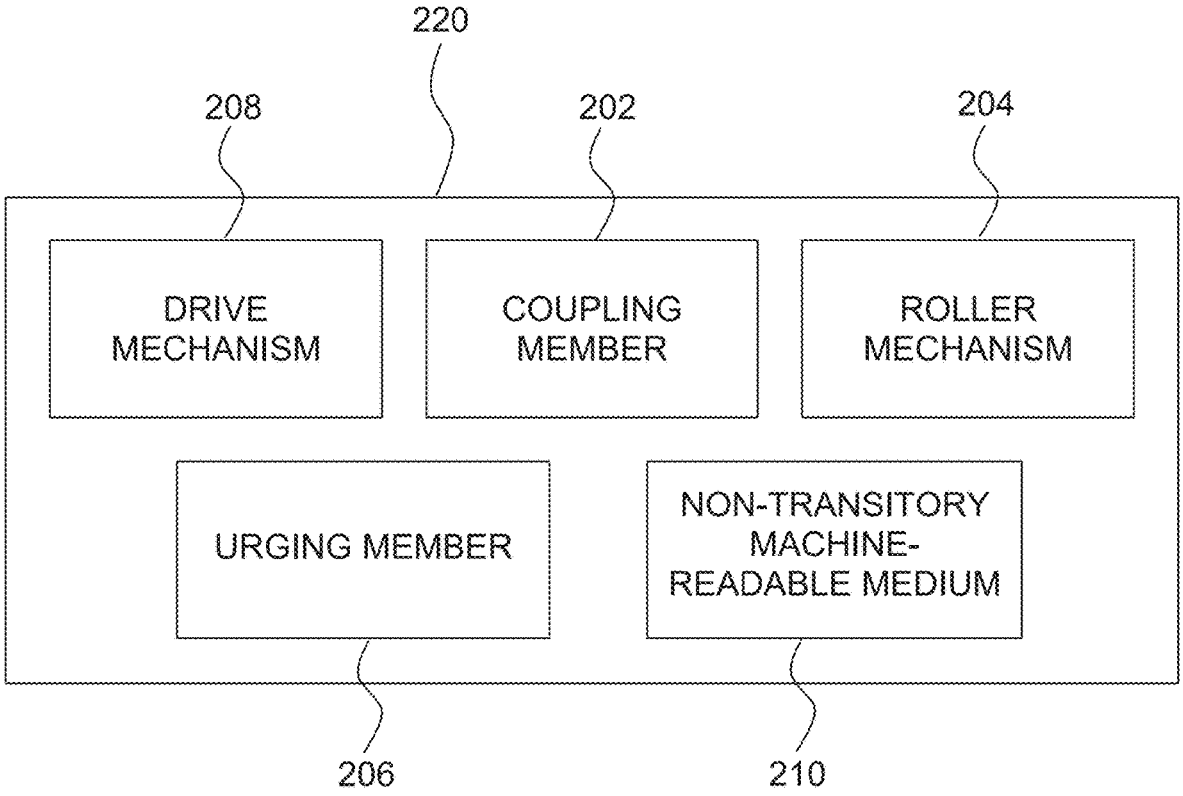
FIG. 2 illustrates an example of an apparatus consistent with the disclosure.

FIG. 2 illustrates an example of an apparatus 220 consistent with the disclosure. In some examples, the apparatus 220 may include a coupling member 202. In some examples, the coupling member 202 may be connected to a printing device. In some examples, the coupling member 202 is connected to the printing device by a drive mechanism 208, In some examples, the drive mechanism 208 may transition and/or move the coupling member 202 in a lateral direction. For example, drive mechanism 208 may cause the coupling member 202 to transition from side to side. In some examples, the coupling member 202 may transition and/or adjust positions as the printing device remains still. In some examples, the coupling member 202 connected to the drive mechanism 208 may assist in the transfer of print substance to print media.

In some example, the drive mechanism 208 may be adjacent to the coupling member 202 and cause the coupling member 202 to transition and/or change positions. That is, the drive mechanism 208 may transition the coupling member 202 from a first position to a second position. For example, the drive mechanism 208 may exert a force on the coupling member 202 that causes the coupling member 202 to transition from the first position to a second position. It should be understood that when an element is referred to as being "adjacent" to another element, it may be on, in contact, connected, next to, or coupled with the other element.

In some examples, the coupling member 202 may be coupled to a roller mechanism 204. The coupling member 202 may be rigidly connected to the roller mechanism 204. For example, the position of the roller mechanism 204 relative to the coupling member 202 may be constant. In some examples, the roller mechanism 204 may transition and/or change positions as the coupling member 202 transitions and/or changes positions. For example, the coupling member 202 and the roller mechanism 204 may be coupled together so that the coupling member 202 and the roller mechanism 204 move and/or transition together. In some examples, the roller mechanism 204 and the coupling member 202 may transition together in a lateral direction.

In some example, the drive mechanism 208 may transition both the roller mechanism 204 and the coupling member 202 from a first position to a second position. For example, as the drive mechanism 208 exerts a force on the coupling member 202 the same force may be applied to the roller mechanism 204 to cause the roller mechanism to transition and/or change positions. In some examples, the disposition of the roller mechanism 204 relative to the coupling member 202 is constant and does not change. For example, the coupling member 202 may move the same distance as the roller mechanism 204 when the coupling member 202 and the roller mechanism 204 transition between positions together. That is, the position of the coupling member 202 relative to the roller mechanism 204 may remain the same as the coupling member and the roller mechanism transition between a first position and a second position. In some examples, as the drive mechanism 208 exerts the force on the coupling member 202 the roller mechanism 204 may transition towards an urging member 206.

For example, the drive mechanism 208 may cause the coupling member 202 and the roller mechanism 204 to transition a distance. That is, the coupling member 202 and the roller mechanism 204 may move a distance to transition from a first position to a second position. In some examples, the drive mechanism 208 may transition the coupling member 202 and the roller mechanism 204 a distance ranging from about 1.0 millimeters to about 15.0 millimeters (mm). For instance, in some examples, the drive mechanism 208 may transition the coupling member 202 and the roller mechanism 204 a distance ranging from about 1.0 mm to about 15.0 mm, 2.54 mm to about 15.0 mm, 3.54 mm to about 15.0 mm, 3.81 mm to about 15.0 mm, 5.35 mm to about 15.0 mm, 6.35 mm to about 15.0 mm, 8.89 mm to about 15.0 mm, 11.43 mm to about 15.0 mm, 13.97 mm to about 15.0 mm, 1.0 mm to about 14.5 mm, 1.0 mm to about 12.7 mm, 1.0 mm to about 10.16 mm, 1.0 mm to about 7.62 mm, 1.0 mm to about 5.08 mm, 1.00 mm to about 4.08 mm, 1.0 mm to about 3.04 mm, 1.0 mm to about 2.54 mm, and 1.0 mm to about 2.0.

In some examples, the drive mechanism 208 may cause the roller mechanism 204 to exert a force on the urging member 206. For example, the drive mechanism 208 may cause the coupling member 202 and the roller mechanism 204 to transition, in unison, from a first position to a second position and exert a force on the urging member 208. In some examples, the urging member 206 may exert a force on the roller mechanism 204 in response to the force exerted by the roller mechanism 204 against the urging member 206. That is, the urging member 206 may cause the roller mechanism 204 and the coupling member 202 to transition, in unison, away from the urging member 206 to a first position.

For example, the urging member 206 may transition the roller mechanism 204 and the coupling member 202 a distance ranging from about 1.0 mm to about 15.0 mm. For instance, in some examples, the urging member 206 may transition the roller mechanism 204 and the coupling member 202 a distance ranging from about 1.0 mm to about 15.0 mm, 2.54 mm to about 15.0 mm, 3.54 mm to about 15.0 mm, 3.81 mm to about 15.0 mm, 5.35 mm to about 15.0 mm, 6.35 mm to about 15.0 mm, 8.89 mm to about 15.0 mm, 11.43 mm to about 15.0 min, 13.97 mm to about 15.0 mm, 1.0 mm to about 14.5 mm, 1.0 mm to about 12.7 mm, 1.0 mm to about 10.16 mm, 1.0 mm to about 7.62 mm, 1.0 mm to about 5.08 min, 1.00 mm to about 4.08 mm, 1.0 mm to about 3.04 mm, 1.0 mm to about 2.54 mm, and 1.0 mm to about 2.0.

Figure 4:
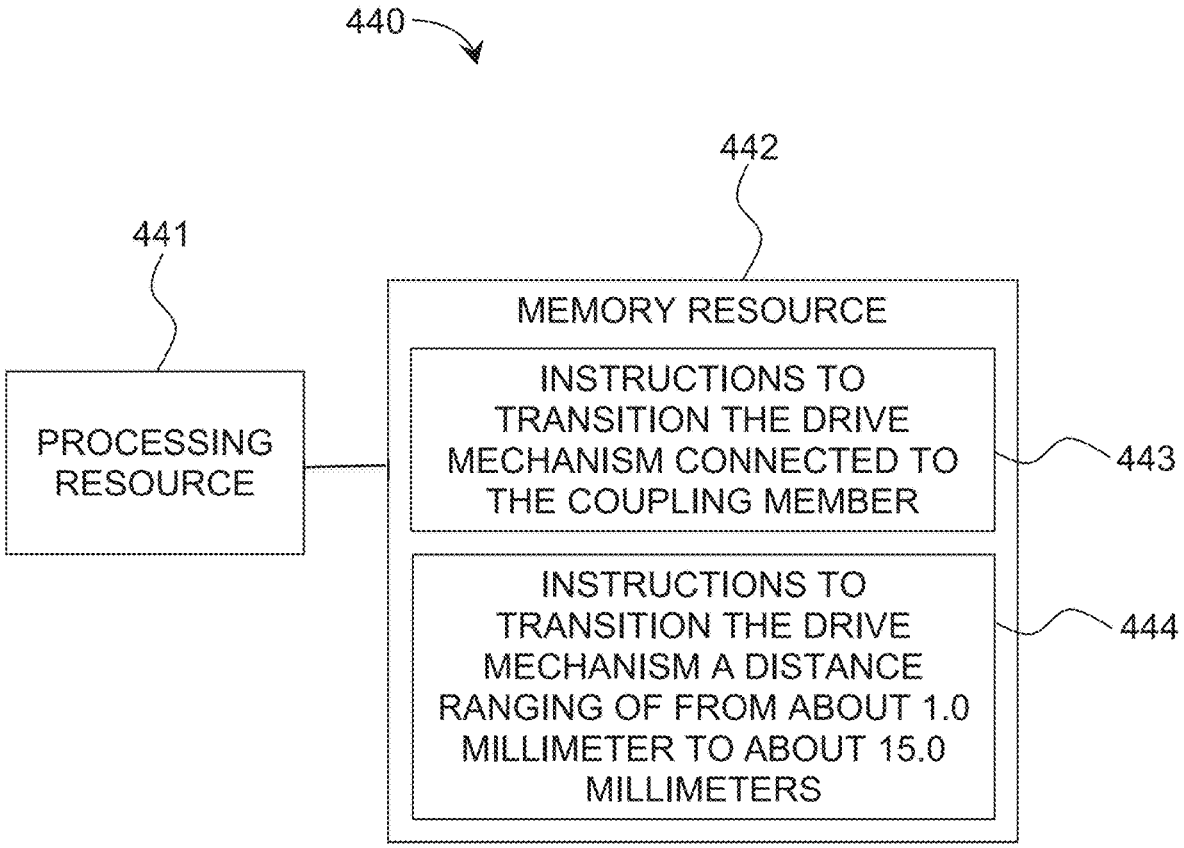
FIG. 4 illustrates an example processing resource and an example memory resource of an example apparatus consistent with the disclosure.

In some examples, the apparatus 220 may include a non-transitory machine-readable medium 210 storing instructions executable by a processing resource (e.g., processing resource 441 of FIG. 4). In some example, the medium 210 may include instructions executable by the processing resource to transition the drive mechanism 208 connected to the coupling member 202. In some examples, the drive mechanism 208 may transition the coupling member 202 and the roller mechanism 204 from a first position to a second position. That is, as the drive mechanism 208 connected to the coupling member 202 transitions the coupling member 202 from a first position to a second position, the roller mechanism 204 may transition with the coupling member 202 since the roller mechanism 204 is coupled to the coupling member 202.

In some examples, the medium 210 may include instructions executable by the processing resource to transition the drive mechanism a distance ranging of from about 1.0 mm to about 15.0 mm. That is, the drive mechanism 208 may cause the coupling member 202 and the roller mechanism 204 to transition from a first position to a second position. In some examples, the coupling member 202 and the roller mechanism 204 may move a distance to transition from a first position to a second position. For example, the drive mechanism 208 may transition the coupling member 202 and the roller mechanism 204 a distance ranging from about 2.54 mm to about 3.8 mm.

Figure 3:
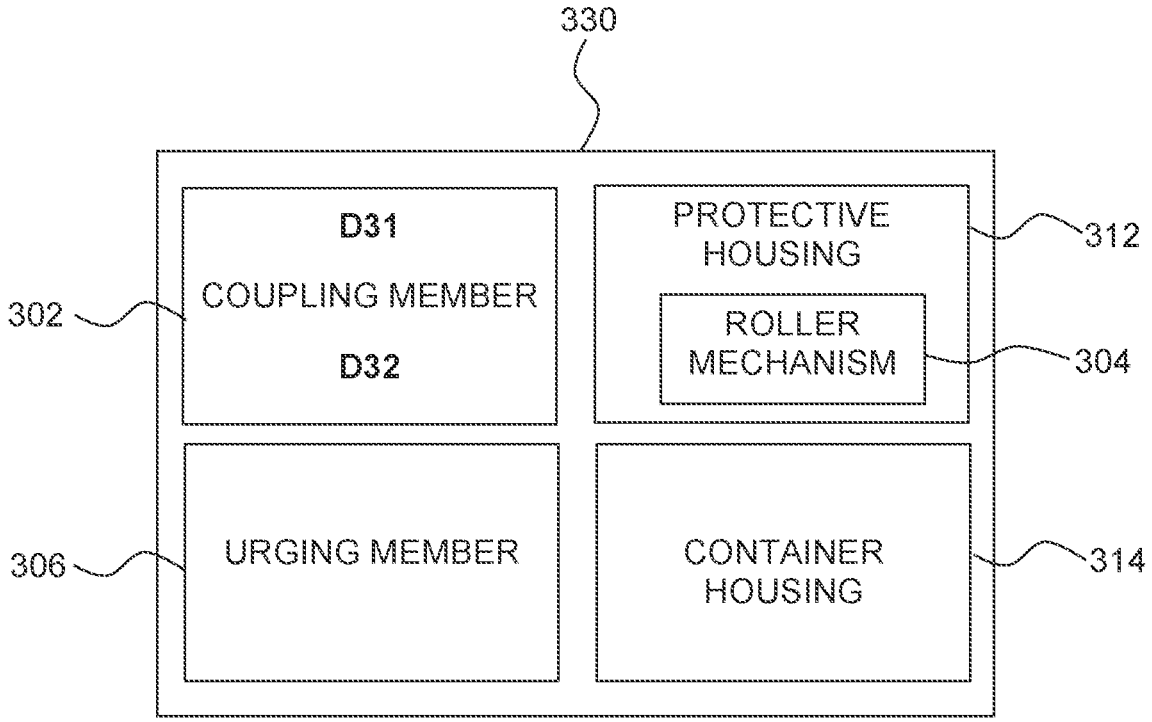
FIG. 3 illustrates an example of a print cartridge consistent with the disclosure.

FIG. 3 illustrates an example of a print cartridge 330 consistent with the disclosure. The print cartridge 330 may include a coupling member 302. In some examples, the coupling member 302 may be connected to a printing device through a drive mechanism. In some examples, the drive mechanism may transition the coupling member to a second position. In some examples, the coupling member 302 may have a first diameter 131 and a second diameter D32. That is, the coupling member may be constructed in a way that allows the coupling member 302 to have two distinct diameters.

For example, the diameter of the coupling member 302 may not be the same throughout the coupling member 302. In some examples, the first diameter D31 of the coupling member 302 may be smaller than the second diameter D32 of the coupling member 302. In some examples, the first diameter D31 of the coupling member 302 may be located at the distal ends of the coupling member. As used herein, "distal ends" refers to ends that are within twenty-five percent of the outer most regions of an object.

In some example, the second diameter D32 of the coupling member 302 may be located in the middle of the coupling member 302. That is, the middle of the coupling member 302 may have a diameter that is distinct and different than the diameter at the distal ends of the coupling member 302. As used herein, "middle" refers to the point or part that is equally distant from all sides and or end.

In another example, a diameter D31 and D32 throughout the coupling member 302 is unchanged.

In some examples, the coupling member is connected to a container housing 314. The container housing 314 may house print substance. In some examples, the coupling member 302 connected to the container housing 314 may assist in the transfer of print substance to print media. In some examples, container housing may be connected to the roller mechanism 304. That is, the roller mechanism 304 may be connected to the container housing 314 on the second side of the roller mechanism 304. In addition, the roller mechanism 304 may be coupled to a coupling member 302 on a first side of the roller mechanism 304.

For example, the roller mechanism 304 is coupled to the coupling member 302 in a manner that allows the coupling member 302 and the roller mechanism 304 to move and/or transition together. That is, the coupling member 302 may be firmly coupled so that the coupling member 302 and the roper mechanism 304 change positions in unison. In some examples, the roper mechanism 304 and the coupling member 302 may transition and/or move in a lateral direction. That is, transitioning the coupling member 302 and roller mechanism 304 in unison may allow the print cartridge 330 to mate with the printing device. For example, as the coupling member 302 and roller mechanism 304 transitions the coupling member 302 may connect with the printing device through the drive mechanism.

In some examples, the position between the coupling member 302 and the roller mechanism 304 does not change. That is, the position of the roller mechanism 304 relative to the coupling member 302 is constant and does not change as the coupling member 302 and the roller mechanism 304 change positions. For example, the coupling member 302 may move the same distance as the roller mechanism 304 as the drive mechanism and/or the urging member moves the roller mechanism 304 and the coupling member 302.

In some examples, the roller mechanism 304 may be mounted to a protective housing 312. In some examples, the protective housing 312 may protect the roller mechanism 304 from nearby objects when the roller mechanism 304 is transitioning positions. In some examples, the protective housing 312 may reduce the amount of friction the roller mechanism 304 experiences from other objects while the roller mechanism 304 transitions positions.

In some examples, the roller mechanism 304 may be connected to the urging member 306 on a second side of the roller mechanism 304. That is, the urging member 306 may have no direct contact with the coupling member 302. In some examples, the urging member 306 may be positioned between the roller mechanism 304 and the container housing 314. In some examples, the container housing 314 may hold the urging member 306 in place as it exerts force onto the roller mechanism 304 and transition the roller mechanism 304 and the coupling member 302 to a first position. In some examples, positioning the urging member 306 away from the coupling member 302 may allow a user to easily identify issues with the print cartridge 330. In addition, the positioning the urging member 306 on the second side of the roller mechanism 304, away from the coupling member 302, may provide more space during assembly and/or may allow for easy repair of the print cartridge 330.

FIG. 4 illustrates an example processing resource 441 and an example memory resource 442 of an example apparatus 440 consistent with the disclosure. As illustrated in FIG. 4, the apparatus 440 includes a processing resource 441 and a memory resource 442. The processing resource 441 may be a hardware processing unit such as a microprocessor, application specific instruction set processor, coprocessor, network processor, or similar hardware circuitry that may cause machine-readable instructions to be executed. In some examples, the processing resource 441 may be a plurality of hardware processing units that may cause machine-readable instructions to be executed. The processing resource 441 may include central processing units (CPUs) among other types of processing units. The memory resource 442 may be any type of volatile or non-volatile memory or storage, such as random-access memory (RAM), flash memory, read-only memory (ROM), storage volumes, a hard disk, or a combination thereof.

The memory resource 442 may store instructions thereon, such as instructions 443 and 444. When executed by the processing resource 441, the instructions may cause the apparatus 440 to perform specific tasks and/or functions. For example, the memory resource 442 may store instructions 443 which may be executed by the processing resource 442 to cause the apparatus 440 to transition the drive mechanism connected to the coupling member. In some examples, the drive mechanism may cause the coupling member and the roller mechanism to move from a first position to a second position. That is, as the drive mechanism connected to the coupling member moves the coupling member, the roller mechanism may transition with the coupling member since the roller mechanism is coupled to the coupling member.

The memory resource 442 may store instructions 444 which may be executed by the processing resource 441 to cause the apparatus 440 to transition the drive mechanism a distance ranging of from about 1.0 mm to about 15.0 mm. That is, the drive mechanism may cause the coupling member and the roller mechanism to move to a second position. For example, the drive mechanism may transition the coupling member and the roller mechanism a distance ranging of from about 2.54 mm to about 8.89 mm.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the disclosure. In addition, the proportion and the relative scale of the elements provided in the figures are intended to illustrate the examples of the disclosure and should not be taken in a limiting sense.

It should be understood that the descriptions of various examples may not be drawn to scale and thus, the descriptions may have a different size and/or configuration other than as shown therein.

What is claimed:

1. A system comprising:

a coupling member to connect to a printing device;

a roller mechanism coupled to the coupling member, wherein a position of the coupling member relative to the roller mechanism remains the same as the coupling member and the roller mechanism transition between a first position and a second position; and an urging member positioned away from the coupling member, wherein:

the urging member is to transition the roller mechanism from the second position to the first position, and the urging member is connected to the roller mechanism to exert a force on the roller mechanism to transition the roller mechanism from the second position to the first position.

2. The system of claim 1, wherein the roller mechanism is mounted to a protective housing to protect the roller mechanism from nearby objects while the roller mechanism is in motion.

3. The system of claim 1, wherein the coupling member has a first diameter and a second diameter.

4. The system of claim 1, wherein the coupling member is connected to the printing device via a print cartridge drive mechanism.

5. The system of claim 1, wherein the urging member is positioned between the roller mechanism and a container housing.

6. A system comprising:

a coupling member to connect to a printing device;

a roller mechanism coupled to the coupling member, wherein a position of the coupling member relative to the roller mechanism remains the same as the coupling member and the roller mechanism transition between a first position and a second position; and an urging member positioned away from the coupling member, wherein:

the urging member is to transition the roller mechanism from the second position to the first position, the coupling member has a first diameter and a second diameter, the first diameter of the coupling member is less than the second diameter of the coupling member, and the first diameter of the coupling member is located at distal ends of the coupling member and the second diameter of the coupling member is located in a middle of the coupling member.

7. A print cartridge comprising:

a coupling member coupled to a roller mechanism on a first side, wherein a position of the coupling member relative to the roller mechanism remains the same as the coupling member and the roller mechanism transition between a first position and a second position, and wherein a diameter throughout the coupling member is unchanged; and the roller mechanism connected to an urging member, wherein the urging member is to exert a force on the roller mechanism to transition the roller mechanism and the coupling member from the second position to the first position.

8. The print cartridge of claim 7, wherein the roller mechanism is to transition a distance ranging of from about 1.0 millimeter (mm) to about 15.0 mm from the second position to the first position responsive to the urging member exerting force on the roller mechanism.

9. The print cartridge of claim 7, wherein the urging member is connected to the roller mechanism on a second side.

10. The print cartridge of claim 7, wherein an interior of the coupling member is hollow.

11. The print cartridge of claim 7, further comprising a drive mechanism to exert a force on the coupling member to transition the coupling member and the roller mechanism.

* * * * *